US007338254B2

(12) United States Patent
Lombard et al.

(10) Patent No.: US 7,338,254 B2
(45) Date of Patent: Mar. 4, 2008

(54) TURBOCHARGER WITH SLIDING PISTON ASSEMBLY

(75) Inventors: Alain R. Lombard, Uxegney (FR); Marylene Ruffinoni, Les Forges (FR); Laurent Vautier, Tendon (FR)

(73) Assignee: Honeywell International, Inc., Morristown, NJ (US)

( * ) Notice: Subject to any disclaimer, the term of this patent is extended or adjusted under 35 U.S.C. 154(b) by 259 days.

(21) Appl. No.: 11/289,214

(22) Filed: Nov. 29, 2005

(65) Prior Publication Data

US 2007/0122268 A1 May 31, 2007

(51) Int. Cl.
*F01D 25/24* (2006.01)

(52) U.S. Cl. ..... 415/167; 415/206

(58) Field of Classification Search ..... 415/167, 415/126, 128, 206; 60/602; 417/407
See application file for complete search history.

(56) References Cited

U.S. PATENT DOCUMENTS 6,694,733 B1 * 2/2004 Bernardini et al. ..... 60/602
6,928,816 B2 * 8/2005 Leavesley ..... 60/602
7,097,432 B1 * 8/2006 Lombard et al. ..... 417/295

* cited by examiner

*Primary Examiner*—Ninh H. Nguyen
(74) *Attorney, Agent, or Firm*—Don Hill; Alston & Bird

(57) ABSTRACT

A turbocharger having a sliding piston assembly comprising a tubular piston disposed in the bore of the turbine housing such that the piston is axially slidable relative to the turbine housing. The piston assembly further comprises a tubular carrier inserted axially into the bore of the turbine housing surrounding the piston and fixed against axial movement relative to the turbine housing, a radially outer surface of the carrier engaging an inner surface of the bore and a radially inner surface of the carrier being slidably engaged by a radially outer surface of the piston. The carrier defines an axial split extending a length of the carrier, and the carrier is resiliently flexible. Accordingly, the axial split allows the carrier to expand and contract in diameter.

15 Claims, 5 Drawing Sheets

TURBOCHARGER WITH SLIDING PISTON ASSEMBLY

BACKGROUND OF THE INVENTION

The present invention relates generally to turbochargers, and relates more particularly to exhaust gas-driven turbochargers having an axially sliding piston for varying the size of a nozzle opening leading into the turbine wheel of the turbine so as to regulate flow through the turbine.

Regulation of the exhaust gas flow through the turbine of an exhaust gas-driven turbocharger provides known operational advantages in terms of improved ability to control the amount of boost delivered by the turbocharger to the associated internal combustion engine. The regulation of exhaust gas flow is accomplished by incorporating variable geometry into the nozzle that leads into the turbine wheel. By varying the size of the nozzle flow area, the flow into the turbine wheel can be regulated, thereby regulating the overall boost provided by the turbocharger's compressor.

Variable-geometry nozzles for turbochargers generally fall into two main categories: variable-vane nozzles, and sliding-piston nozzles. Vanes are often included in the turbine nozzle for directing the exhaust gas into the turbine in an advantageous direction. Typically a row of circumferentially spaced vanes extend axially across the nozzle. Exhaust gas from a chamber surrounding the turbine wheel flows generally radially inwardly through passages between the vanes, and the vanes turn the flow to direct the flow in a desired direction into the turbine wheel. In a variable-vane nozzle, the vanes are rotatable about their axes to vary the angle at which the vanes are set, thereby varying the flow area of the passages between the vanes.

In the sliding-piston type of nozzle, the nozzle may also include vanes, but the vanes are fixed in position. Variation of the nozzle flow area is accomplished by an axially sliding piston that slides in a bore in the turbine housing. The piston is tubular and is located just radially inwardly of the nozzle. Axial movement of the piston is effective to vary the axial extent of the nozzle opening leading into the turbine wheel. When vanes are included in the nozzle, the piston can slide adjacent to radially inner (i.e., trailing) edges of the vanes; alternatively, the piston and vanes can overlap in the radial direction and the piston can include slots for receiving at least a portion of the vanes as the piston is slid axially to adjust the nozzle opening.

The sliding-piston type of variable nozzle offers the advantage of being mechanically simpler than the variable-vane nozzle. Nevertheless, other drawbacks have generally been associated with sliding-piston type variable nozzles. The piston must be somewhat smaller in diameter than the inner diameter of the turbine housing bore to ensure that the piston can freely slide without binding. As a result, a potential leakage pathway exists through the inevitable gap between the piston and bore. Leakage of exhaust gas through this pathway reduces turbine performance.

Furthermore, dimensional changes in the turbine housing and/or piston as a result of thermal expansion and contraction can lead to growth of the gap and hence increased leakage. Typically the piston is of a different material from that of the turbine housing, and the two materials have different coefficients of thermal expansion. As a result, it is generally necessary to design the piston-to-housing clearance on the high side at low temperatures to avoid binding of the piston at high temperatures, or vice versa, depending on the relative coefficients. Accordingly, during some operating conditions the gap between the piston and housing is relatively large and leads to high gas leakage, which is harmful to turbocharger performance.

BRIEF SUMMARY OF THE INVENTION

The present invention addresses the above needs and achieves other advantages. A turbocharger in accordance with one embodiment of the invention comprises a center housing containing a bearing assembly and a rotary shaft mounted in the bearing assembly, a compressor wheel affixed to one end of the shaft, and a turbine wheel affixed to an opposite end of the shaft and disposed in an axial bore of a turbine housing coupled to an opposite side of the center housing. The turbine housing defines a chamber surrounding the turbine wheel for receiving exhaust gas to be directed into the turbine wheel, and defines a nozzle leading from the chamber to the turbine wheel. The turbocharger further comprises a sliding piston assembly disposed in the bore of the turbine housing.

The piston assembly comprises a tubular piston disposed in the bore of the turbine housing such that the piston is axially slidable relative to the turbine housing between a closed position and an open position, the piston in the closed position substantially blocking exhaust gas from passing through the nozzle to the turbine wheel, the piston progressively unblocking the nozzle as the piston travels toward the open position. The piston assembly further comprises a tubular carrier inserted axially into the bore of the turbine housing surrounding the piston and fixed against axial movement relative to the turbine housing, a radially outer surface of the carrier engaging an inner surface of the bore and a radially inner surface of the carrier being slidably engaged by a radially outer surface of the piston. The carrier defines an axial split extending a length of the carrier, and the carrier is resiliently flexible. Accordingly, the axial split allows the carrier to expand and contract in diameter.

In accordance with the invention, the carrier's inner diameter in a relaxed state is only slightly greater than the outer diameter of the piston such that the gap between them through which leakage of exhaust gas can occur is a very small. The carrier is able to adjust to changes in diameter of the turbine housing bore and piston (which can result from thermal expansion and contraction) so that the gap between the carrier and piston remains very small. Furthermore, binding between the piston and carrier can be avoided because the carrier can expand.

In one embodiment of the invention, the carrier has a substantial axial length, preferably approximately equal to that of the piston. The carrier can include axially elongated apertures through its side wall, the apertures being circumferentially spaced about the carrier. The apertures not only reduce the weight of the carrier, but also provide access to the piston through the carrier side wall for a piston actuating linkage that connects to the piston for moving the piston axially in the turbine housing.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
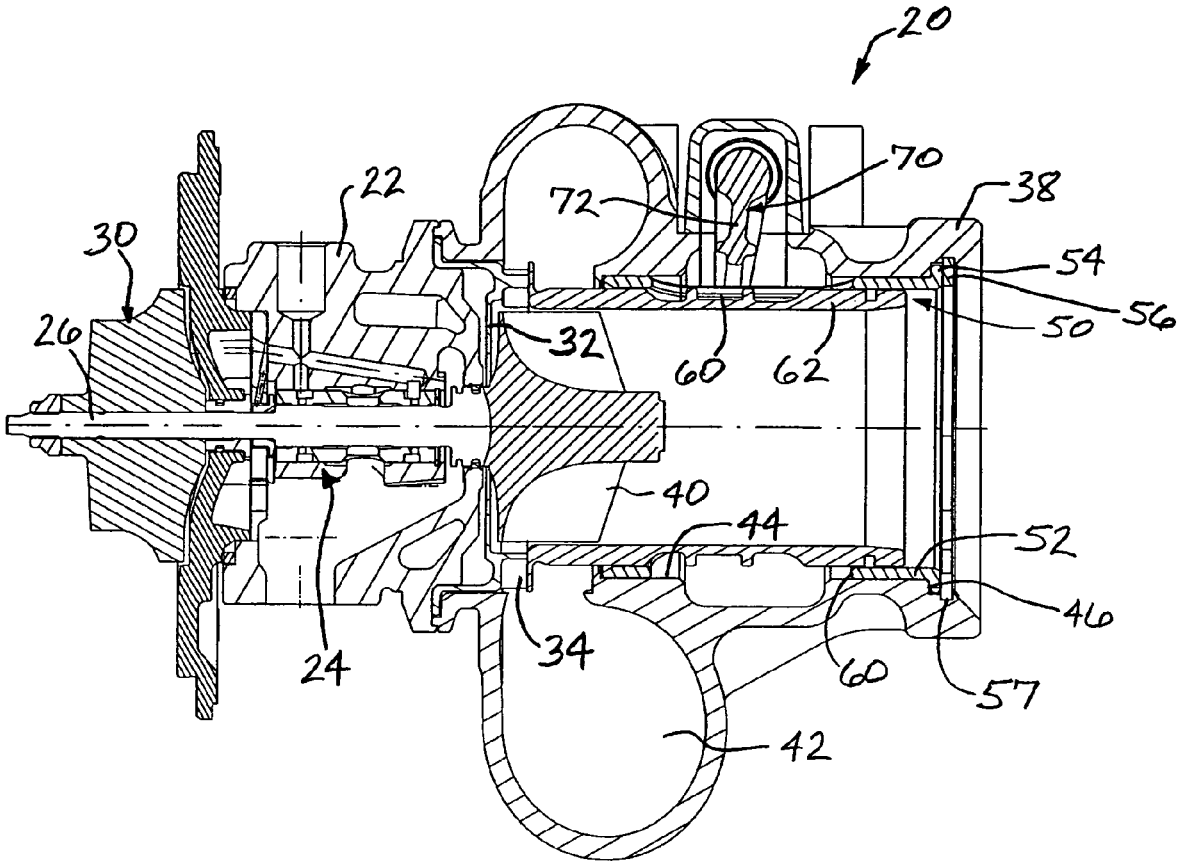
FIG. 1 is a cross-sectional view of a turbocharger in accordance with one embodiment of the invention, showing the piston in a closed position.
Figure 2:
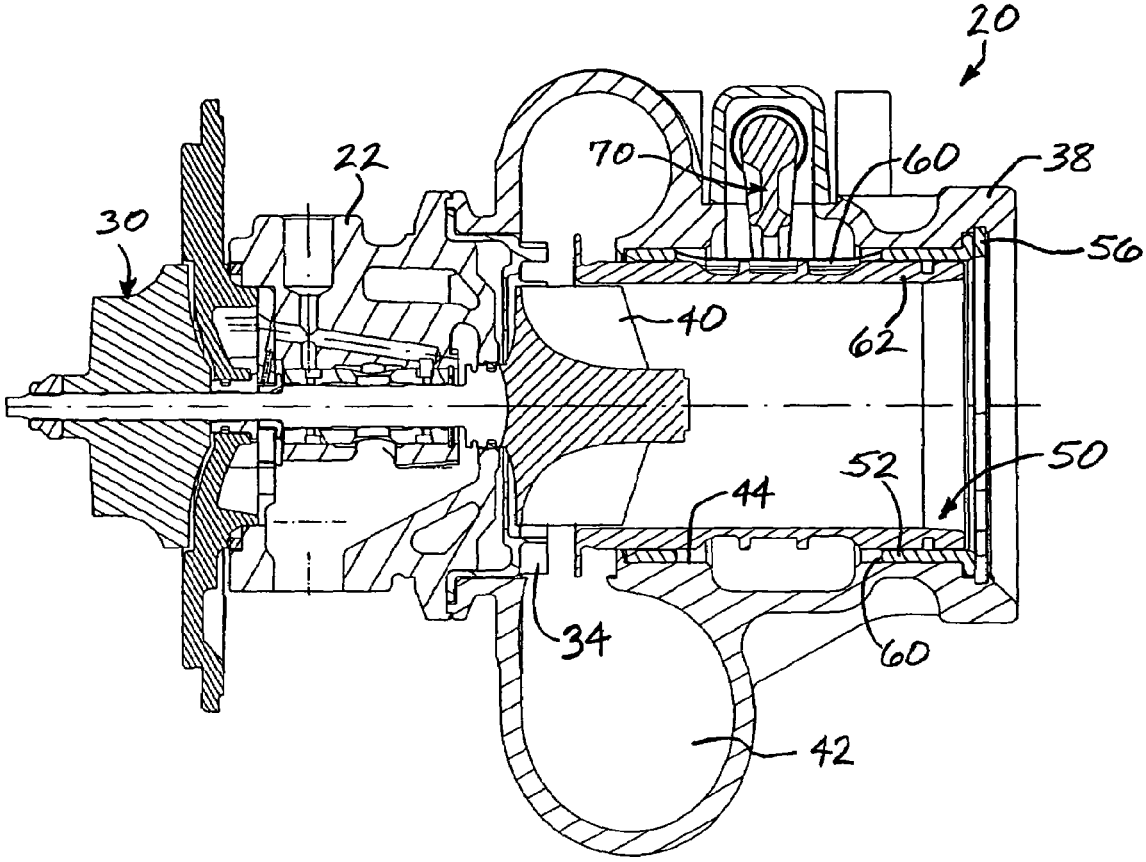
FIG. 2 is a view similar to FIG. 1, with the piston in a partially open position.
Figure 3:
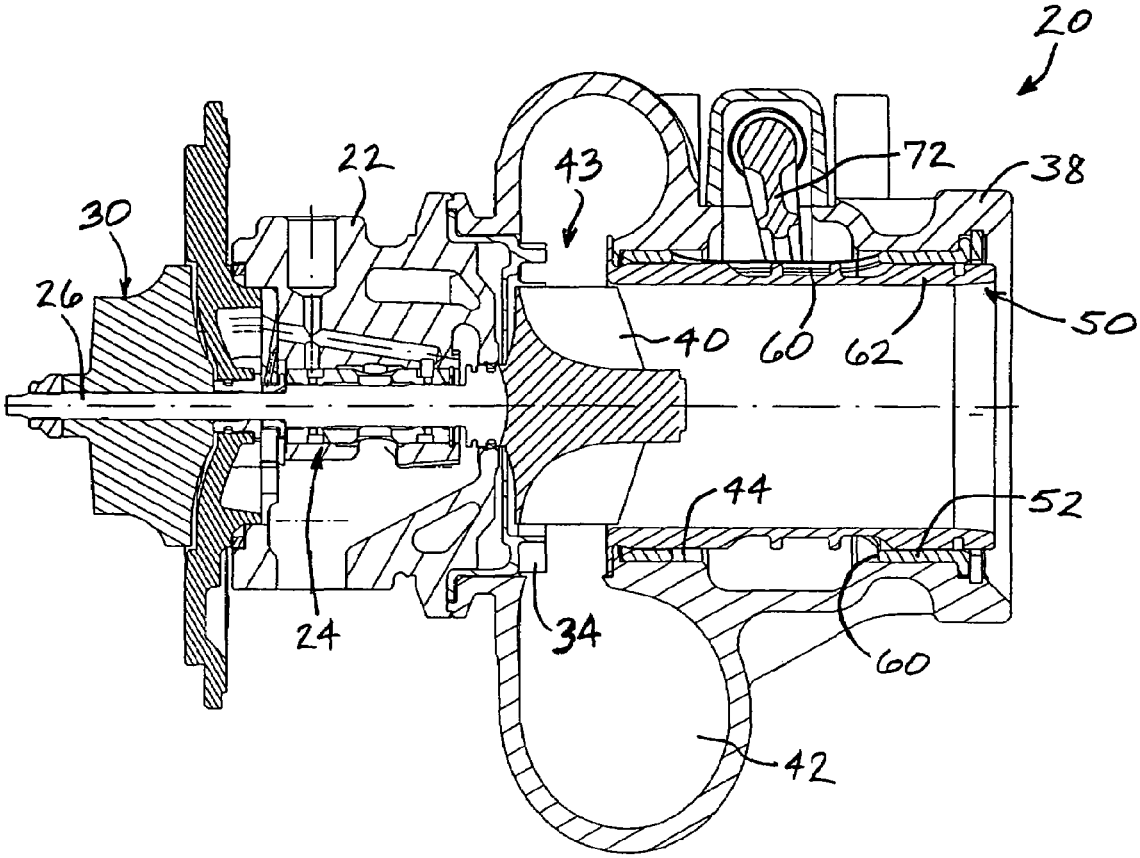
FIG. 3 is a view similar to FIG. 2, showing the piston in a fully open position.
Figure 4:
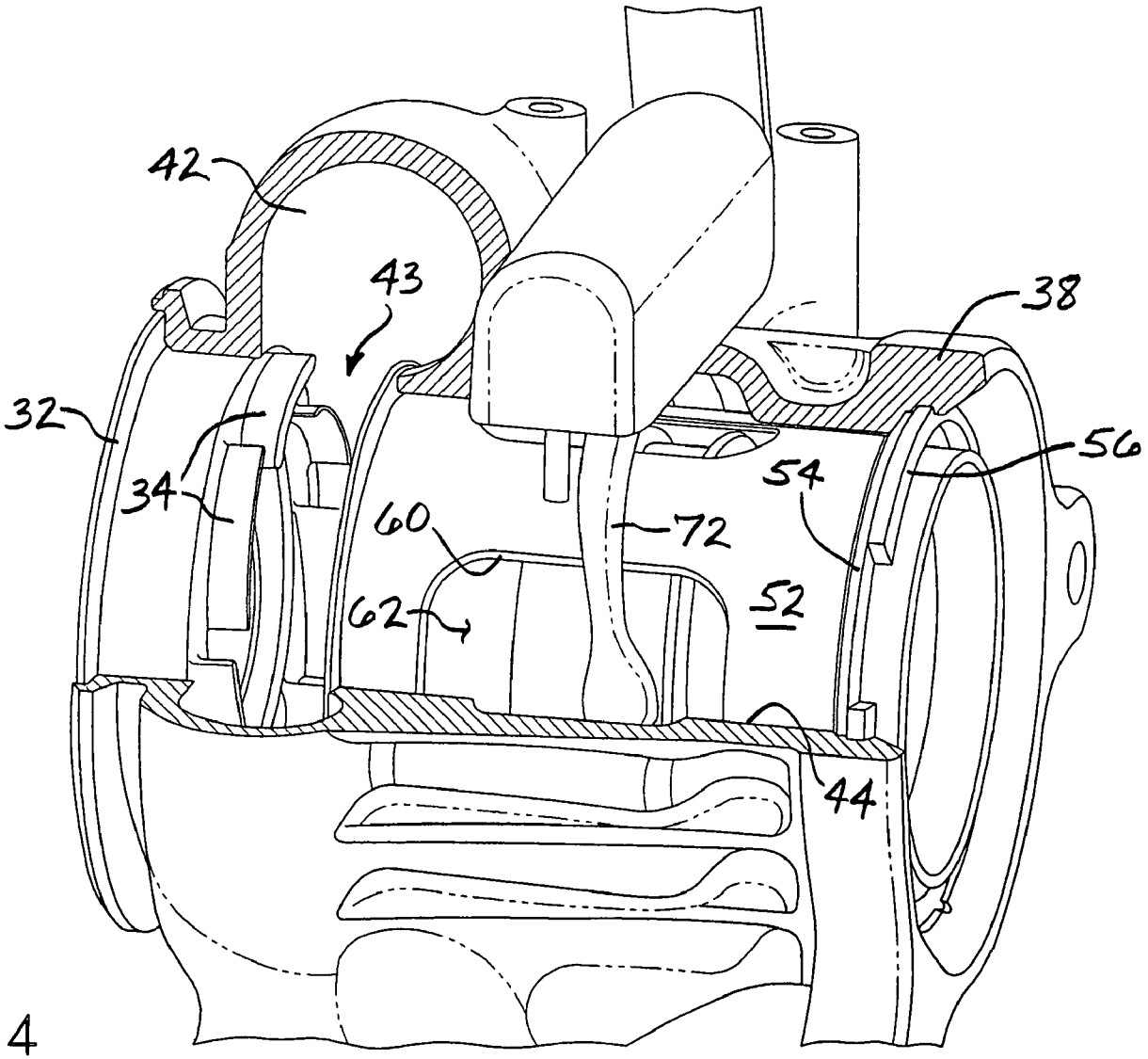
FIG. 4 is an isometric view of a turbine assembly in accordance with one embodiment of the invention.

A turbocharger 20 in accordance with one embodiment of the invention is shown in FIGS. 1 through 3. The turbocharger includes a center housing 22 that contains bearings 24 for a rotary shaft 26 of the turbocharger. A compressor housing (not shown) is coupled to one side of the center housing. A compressor wheel 30 is mounted on one end of the shaft 26 and is disposed in the compressor housing. Although not illustrated, it will be understood that the compressor housing defines an inlet through which air is drawn into the compressor wheel 30, which compresses the air, and further defines a diffuser through which the compressed air is discharged from the compressor wheel into a volute surrounding the compressor wheel. From the volute, the air is delivered to the intake of an internal combustion engine (not shown). The turbocharger further comprises a turbine housing 38 coupled to the opposite side of the center housing 22. A turbine wheel 40 is mounted on the opposite end of the shaft 26 from the compressor wheel and is disposed in the turbine housing. The turbine housing defines a chamber 42 that surrounds the turbine wheel 40 and receives exhaust gas from the internal combustion engine. Exhaust gas is directed from the chamber 42 through a nozzle 43 (FIG. 4) into the turbine wheel 40, which expands the exhaust gas and is driven thereby so as to drive the compressor wheel.

A heat shield 32 is disposed between the center housing 22 and turbine housing 38. The heat shields supports an array of circumferentially spaced vanes 34 that extend axially from the heat shield partway across the axial extent of the nozzle 43.

The turbine housing 38 defines a generally cylindrical bore 44 whose diameter generally corresponds to a radially innermost extent of the chamber 42. The turbine wheel 40 resides in an upstream end of the bore 44 and the turbine wheel's rotational axis is substantially coaxial with the bore. The term "upstream" in this context refers to the direction of exhaust gas flow through the bore 44, as the exhaust gas in the chamber 42 flows into the turbine wheel 40 and is then turned to flow generally axially (left to right in FIG. 1) through the bore 44 to its downstream end.

Figure 5:
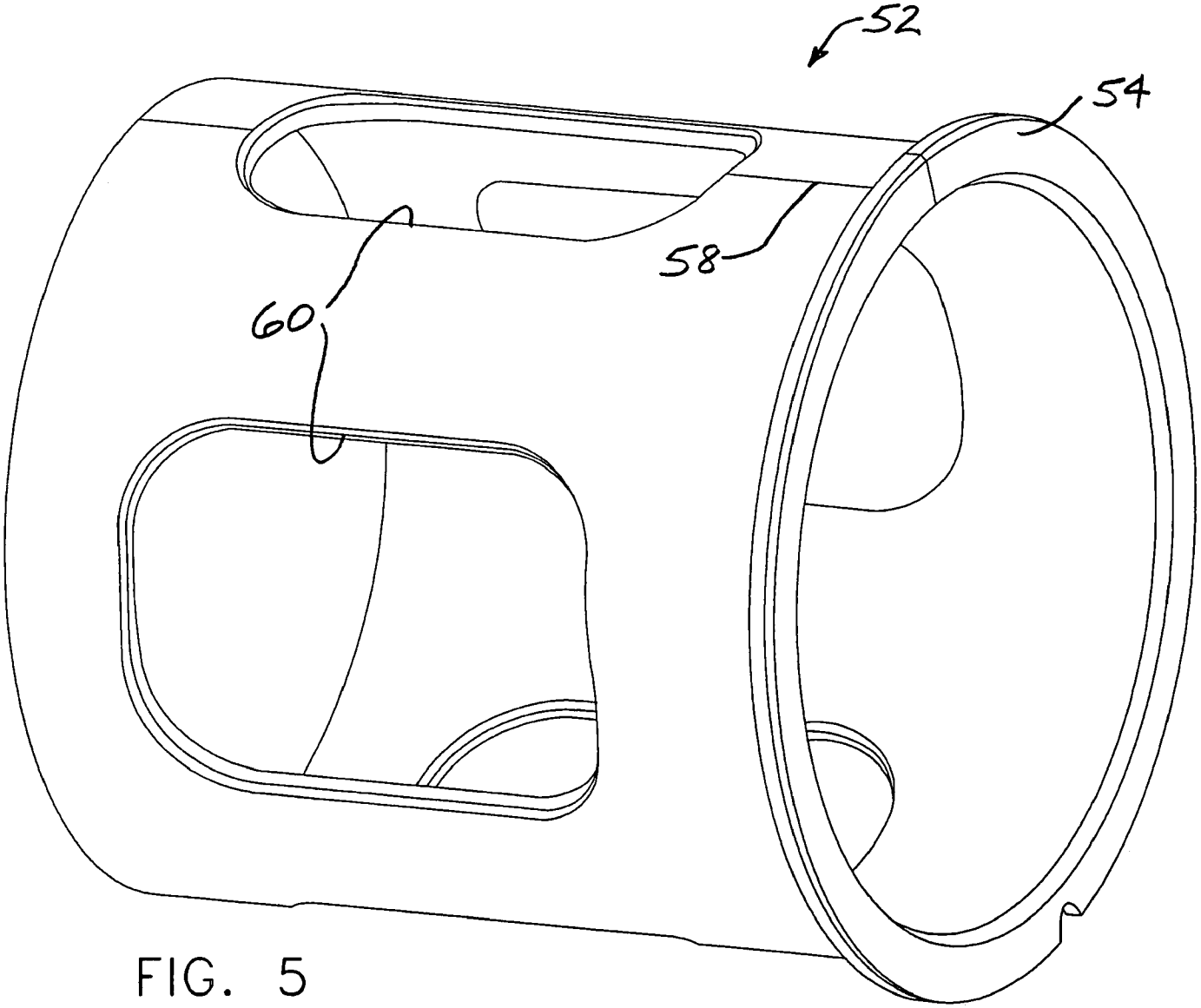
FIG. 5 is an isometric view of the carrier in accordance with one embodiment of the invention.

With reference particularly to FIGS. 2 and 3, the turbocharger includes a sliding piston assembly 50 that resides in the bore 44 of the turbine housing. The piston assembly comprises a tubular carrier 52 whose outer diameter is slightly smaller than the diameter of the turbine housing bore 44 such that the carrier 52 can be slid axially into the bore 44 from its downstream end (i.e., slid right to left in FIG. 2). The tubular carrier is shown in isolation in FIG. 5. The bore 44 includes a radially inward step 46 that faces downstream and the carrier includes a radially outwardly projecting flange or protuberance 54 that abuts the step 46. A retainer clip or ring 56 is snapped into a groove 57 in the inner surface of the bore 44 behind the carrier 52 to retain the carrier in the turbine housing. Thus, the carrier is prevented from moving axially in the bore 44 by the step 46 and the retainer ring 56.

The piston assembly 50 further comprises a piston 62 of tubular form. The piston is coaxially disposed within the central bore of the carrier 52 and is slidable relative to the carrier in the axial direction. The piston is axially slidable between a closed position as shown in FIG. 1 wherein the piston abuts the ends of the vanes 34, an open position as shown in FIG. 3 wherein the piston is spaced from the vanes by a relatively larger distance, and various partially open positions therebetween such as the position shown in FIG. 2 wherein the piston is spaced by smaller distances from the vanes. In the closed position, the size of the nozzle through which exhaust gas flows from the chamber 42 to the turbine wheel is a minimum and the exhaust gas is constrained to flow through the row of vanes 34. In the open position of the piston, the nozzle flow area is a maximum and part of the gas flows through the vanes while the remainder flows through a vaneless annular opening adjacent the vanes.

The carrier 52 has an axial split 58 (FIG. 5) extending the length of the carrier. The split enables the carrier to expand and contract in diameter in response to thermal effects or other causes. The carrier advantageously has an inner diameter only slightly greater than the outer diameter of the piston 62, such that a very small gap exists between the carrier and piston. Accordingly, leakage flow through the gap is minimized. Because the carrier can expand and contract in diameter, there is no need to make the gap large to facilitate assembly or to accommodate dimensional changes during operation. The ability of the carrier to expand also means that binding of the piston is avoided.

The carrier 52 includes a plurality of apertures 60 through the side wall of the carrier. The apertures are axially elongated for purposes explained below. The apertures are spaced about the circumference of the carrier.

The turbocharger also includes a piston actuating linkage comprising a fork-shaped swing arm 70. The swing arm has a pair of arms 72 whose distal ends extend through two of the apertures 60 and engage the piston 62 at diametrically opposite locations of the piston. The swing arm is disposed adjacent the outer surface of the carrier and resides in a portion of the bore 44 that has an enlarged diameter. The swing arm is pivotable about a transverse axis so as to cause the piston to be advanced axially within the carrier 52. FIG. 1 shows the piston in the closed position, wherein the distal ends of the arms 72 are positioned toward one end of the apertures 60. FIG. 3 shows the piston in the open position in which the arms are positioned toward the other end of the apertures. The apertures are axially elongated to allow the requisite degree of axial travel of the arms 72. The swing arm 70 is actuated by an actuator mechanism coupled to an actuator such as a vacuum chamber actuator or the like (not shown).

The provision of the axially split carrier 52 allows the carrier to substantially conform to the outer diameter of the piston at all operating conditions, the carrier expanding or contracting in diameter along with the piston as temperature changes. Accordingly, the carrier reduces gas leakage by maintaining a minimal gap between the carrier and piston. Although some gas leakage can occur through the axial split when it opens up, but it is expected this leakage would be small. Gas leakage between the carrier and the turbine housing is minimized by the engagement between the lip or projection 54 and the corresponding step surface 46 of the turbine housing, and by the snap ring 56 that presses the projection 54 against the surface 46.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbocharger comprising:

a center housing containing a bearing assembly and a rotary shaft mounted in the bearing assembly;

a compressor wheel affixed to one end of the shaft;

a turbine wheel affixed to an opposite end of the shaft and disposed in an axial bore of a turbine housing coupled to an opposite side of the center housing, the turbine housing defining a chamber surrounding the turbine wheel for receiving exhaust gas to be directed into the turbine wheel, and defining a nozzle leading from the chamber to the turbine wheel; and a sliding piston assembly comprising:

a tubular piston disposed in the bore of the turbine housing such that the piston is axially slidable relative to the turbine housing between a closed position and an open position, the piston in the closed position substantially blocking exhaust gas from passing through the nozzle to the turbine wheel, the piston progressively unblocking the nozzle as the piston travels toward the open position; and a tubular carrier inserted axially into the bore of the turbine housing surrounding the piston and fixed against axial movement relative to the turbine housing, a radially outer surface of the carrier engaging an inner surface of the bore and a radially inner surface of the carrier being slidably engaged by a radially outer surface of the piston, the carrier defining an axial split extending a length of the carrier, and the carrier being resiliently flexible, such that the axial split allows the carrier to expand and contract in diameter.

2. The turbocharger of claim 1, wherein the inner surface of the bore of the turbine housing defines a step surface and the carrier defines a radially outwardly projecting protuberance that engages the step surface for fixing the carrier against axial movement and for providing sealing between the carrier and turbine housing.

3. The turbocharger of claim 2, further comprising a snap ring engaging a groove in the turbine housing, the snap ring engaging the carrier and pressing the carrier against the step surface.

4. The turbocharger of claim 1, wherein the length of the carrier is approximately equal to that of the piston.

5. The turbocharger of claim 1, wherein the carrier defines a plurality of apertures extending through a side wall of the carrier and circumferentially spaced about the carrier, the apertures being axially elongated.

6. The turbocharger of claim 5, further comprising a piston actuating linkage disposed adjacent the outer surface of the carrier and having piston-engaging members that extend through the apertures in the carrier and connect to the piston.

7. The turbocharger of claim 6, wherein the piston actuating linkage comprises a fork-shaped swing arm, the piston-engaging members comprising two arms of the swing arm, the arms having distal ends that extend through the apertures in the carrier and connect to the piston at diametrically opposite locations thereof, the swing arm being pivotable about a transverse axis so as to cause the arms to axially move the piston within the carrier.

8. The turbocharger of claim 7, wherein an axially intermediate portion of the bore of the turbine housing has an enlarged diameter for accommodating the swing arm.

9. The turbocharger of claim 1, wherein the bore of the turbine housing and the carrier are structured and arranged such that the carrier is insertable axially into the bore from one end of the bore.

10. A sliding piston assembly for a turbine of a turbocharger, the turbine comprising a turbine housing defining an axial bore in which a turbine wheel is disposed and defining a chamber surrounding the turbine wheel for receiving exhaust gas to be directed into the turbine wheel, and defining a nozzle leading from the chamber to the turbine wheel, the sliding piston assembly comprising:

a tubular piston structured and arranged to be disposed in the bore of the turbine housing such that the piston is axially slidable relative to the turbine housing between a closed position and an open position, the piston in the closed position substantially blocking exhaust gas from passing through the nozzle to the turbine wheel, the piston progressively unblocking the nozzle as the piston travels toward the open position; and a tubular carrier structured and arranged to be inserted axially into the bore of the turbine housing surrounding the piston and fixed against axial movement relative to the turbine housing, the carrier comprising a radially outer surface for engaging an inner surface of the bore and a radially inner surface of the carrier slidably engaged by a radially outer surface of the piston, the carrier defining an axial split extending a length of the carrier, and the carrier being resiliently flexible, such that the axial split allows the carrier to expand and contract in diameter.

11. The sliding piston assembly of claim 10, wherein the carrier defines a radially outwardly projecting protuberance for engaging a step surface of the turbine housing for fixing the carrier against axial movement and for providing sealing between the carrier and turbine housing.

12. The sliding piston assembly of claim 10, wherein the length of the carrier is approximately equal to that of the piston.

13. The sliding piston assembly of claim 10, wherein the carrier defines a plurality of apertures extending through a side wall of the carrier and circumferentially spaced about the carrier, the apertures being axially elongated.

14. The sliding piston assembly of claim 13, further comprising a piston actuating linkage disposed adjacent the outer surface of the carrier and having piston-engaging members that extend through the apertures in the carrier and connect to the piston.

15. The sliding piston assembly of claim 14, wherein the piston actuating linkage comprises a fork-shaped swing arm, the piston-engaging members comprising two arms of the swing arm, the arms having distal ends that extend through the apertures in the carrier and connect to the piston at diametrically opposite locations thereof, the swing arm being pivotable about a transverse axis so as to cause the arms to axially move the piston within the carrier.

* * * * *